United States Patent [19]

Bergman

[11] 4,452,165

[45] Jun. 5, 1984

[54] METHOD AND APPARATUS FOR SUPPRESSING HEAVE IN A FLOATING STRUCTURE

[75] Inventor: Gunnar B. Bergman, Santa Barbara, Calif.

[73] Assignee: Seatek Corporation, Goleta, Calif.

[21] Appl. No.: 325,559

[22] Filed: Nov. 27, 1981

[51] Int. Cl.[3] ..... B63B 39/03

[52] U.S. Cl. ..... 114/125; 114/265

[58] Field of Search ..... 114/265, 125

[56] References Cited

U.S. PATENT DOCUMENTS 3,285,216 11/1966 Field et al. ..... 114/125 X 3,391,666 7/1968 Schuller, Jr. ..... 114/265 X 4,176,614 12/1979 Goss et al. ..... 114/265 X

FOREIGN PATENT DOCUMENTS 52404 2/1912 Fed. Rep. of Germany ..... 114/125

*Primary Examiner*—Sherman D. Basinger

*Attorney, Agent, or Firm*—F. D. La Riviere

[57] ABSTRACT

A heave resonant damper for semisubmersible platforms includes tanks and ducts constructed so that their resonant period approximately equals the resonant heave period of the platform, wherein the ducts have selectively varied cross-sectional area to optimize damping.

15 Claims, 18 Drawing Figures

METHOD AND APPARATUS FOR SUPPRESSING HEAVE IN A FLOATING STRUCTURE

BACKGROUND AND SUMMARY OF THE INVENTION

Typical semisubmersible platforms used in offshore drilling operations are subject to pronounced heave resonance. Such resonance occurs as the platform is subjected to the natural wave action of the sea when anchored on site, and is also described in U.S. Pat. No. 4,167,147. The aforementioned patent teaches stabilization of such platforms by velocity damping of platform oscillatory displacement by applying an anti-heave force that is a function of heave velocity of the platform. The reference also cites numerous other types of apparatus and methods for controlling stability and minimizing motion of floating platforms.

According to the present invention, heave resonance can be suppressed by resonant heave dampers comprising tanks mounted in or on the columns of the platform approximately where the ambient waterline intersects the columns. Each tank has a duct leading from its bottom to a point at the bottom of the platform pontoon. The ducts may also be terminated just above or on the side of the pontoon. The tanks are in continuous communication with the water via the duct, and are in continuous communication with the atmosphere above the ambient surface of the water therein via vent holes in the top thereof. Water flowing into and out of the tanks via the ducts also has resonant characteristics. The resonant period of the damper is designed to be approximately equal to the resonant heave period of the platform.

Resonant heave dampers constructed according to the present invention are passive since natural wave action and platform motion causes water to flow into and out of the tanks via the ducts. The cross-sectional area of the ducts is substantially smaller than the cross-sectional area of the tanks, and is selectively varied at each end to increase or decrease the damping characteristics of the damper. Such dampers may also be installed on the outside of the platform column. In that configuration, they should be distinguished from the control force tanks described in U.S. Pat. No. 4,176,614, which require an air pump connected to the tank above the ambient surface of the water therein.

DESCRIPTION OF THE PREFERRED EMBODIMENT

Figure 1:
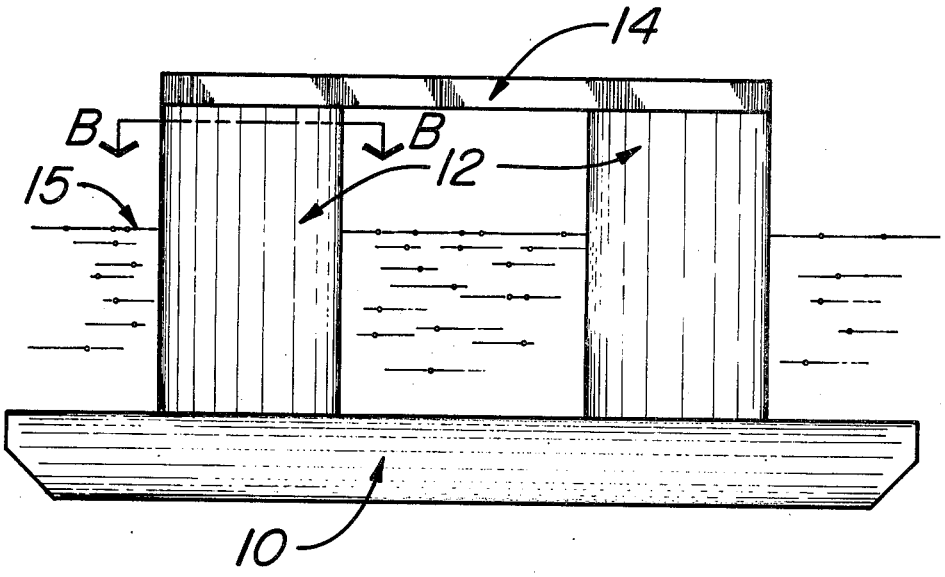
FIG. 1 is a side view of a typical semisubmersible platform, with which the present invention may be employed.
Figure 2:
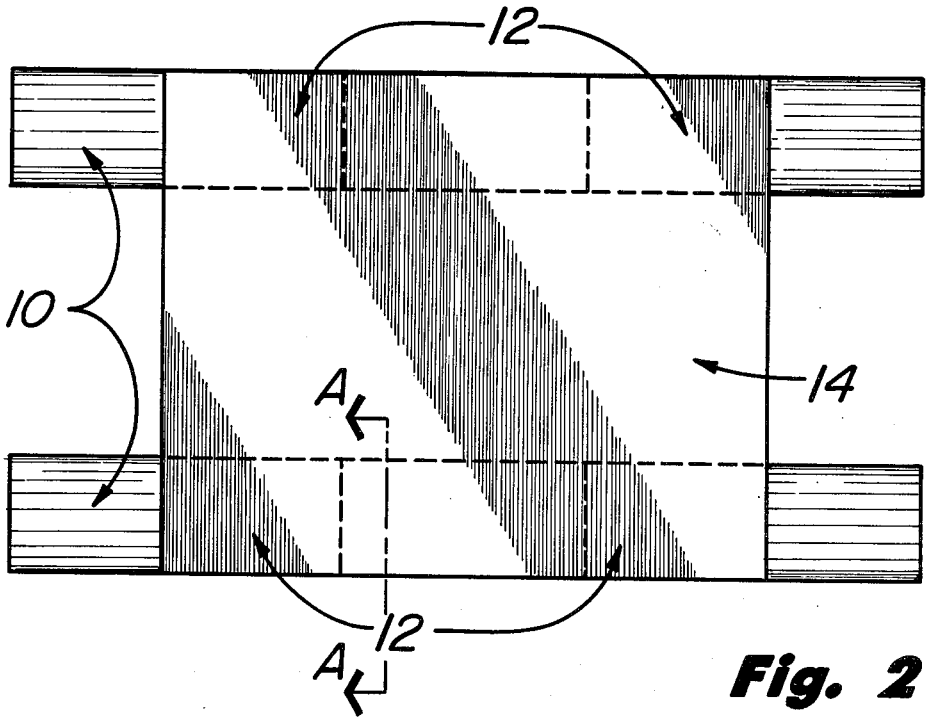
FIG. 2 is a top view of the platform of FIG. 1.

Referring first to FIGS. 1 and 2, a typical semisubmersible platform comprises platform deck 14, coupled to pontoon 10 by column 2. Frequently, such a semisubmersible platform includes four columns on two pontoons.

Figure 3A:
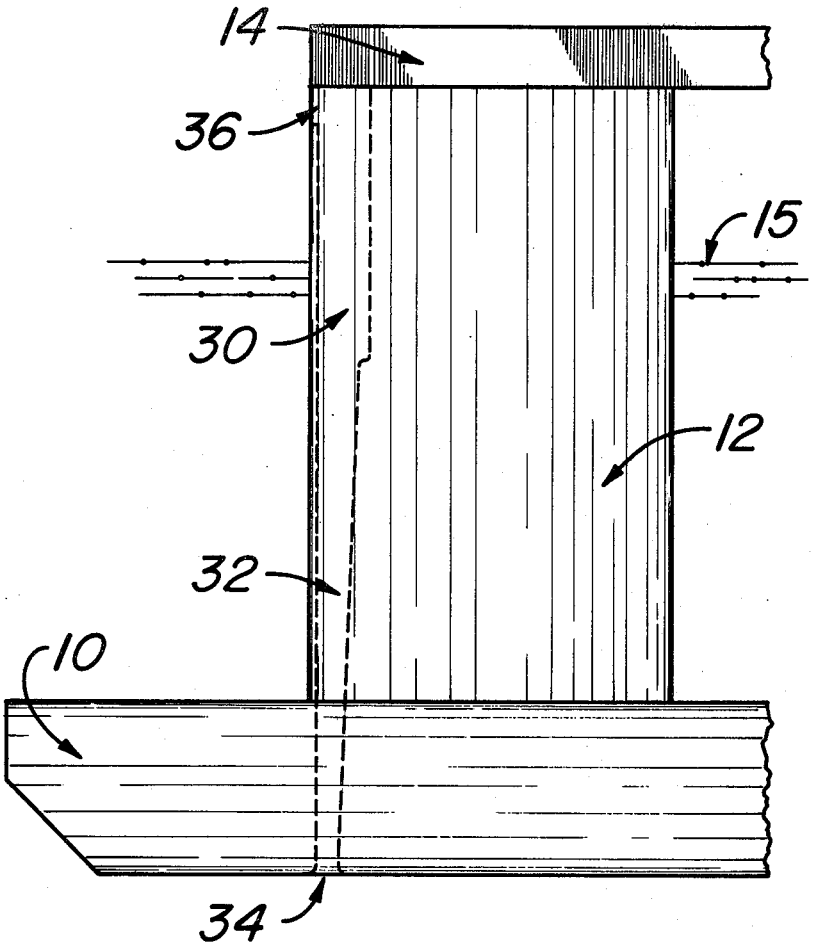
FIGS. 3A and 3B are a side view and a top view, respectively, of a passive heave damper constructed according to one embodiment of the present invention in one column of the platform of FIG. 1.
Figure 3B:
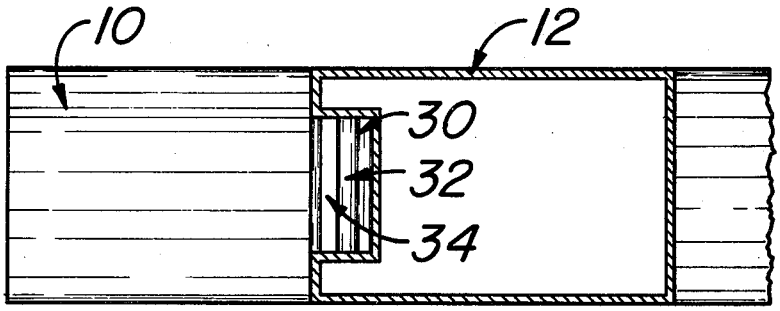

Referring now to FIGS. 3A and 3B, a resonant heave damper constructed in accordance with the present invention comprises tank 30 having airvent 36 for outflow and intake of air above water line 15 and duct 32 extending from the bottom of the tank through pontoon 10 where it opens to the water at 34. In the preferred embodiment, duct 32 extends through pontoon 10.

The cross-sectional area of duct 32 is substantially less than the cross-sectional area of tank 30, being typically on the order of 15% of the cross-sectional area of tank 30, and shaped, gently tapering to a smaller cross-section from the bottom of tank 30 to the bottom of pontoon 10 at opening 34. Vent 36 permits intake and outflow of air as the water level therein fluctuates. Water enters tank 30 only via opening 34 through duct 32.

The flow of water in and out of tank 30 via smaller cross-sectional duct 32 has resonant characteristics. Damping is achieved by designing the resonant period of the damper to be approximately equal to the resonant heave period of the entire semisubmersible platform and by designing the ducts to dissipate energy by controlling pressure losses owing to friction and turbulence of water in and around the duct.

The natural period of oscillation of a heave damper for a semisubmersible platform constructed in accordance with the present invention is related to the cross-sectional area of the tank, the cross-sectional area of the duct and its length. However, the damping effect of the tank-duct system on the platform is related to the energy dissipated by turbulence set up in the water at or near the ends of the duct and, to a lesser extent, the flow of water into and out of the tanks. For a duct uniform cross-sectional area, the turbulence created would typically dissipate too much energy for good damping performance. Turbulence can be reduced, however, to optimal level by shaping the duct at one end or, in some cases, both ends. Such shaping, also known as flaring, causes the flow velocity of the water in the flared portion of the duct to be less, which results in reduced turbulence.

The energy dissipation for the duct consists of three factors: the entrance loss, $f_{ent}$; friction loss, $f_p$; and exit loss, $f_{ex}$. Expressed as a fraction of the kinetic head in the duct, the factors range in value as follows: $f_{ent}=0.05-0.23$, $f_p=0.15-0.22$, $f_{ex}=1.0$. Thus, for a total dissipation of 1.2–1.45, the exit loss is the major contributor. $f_{ex}$ is also the easiest to control. Such control is achieved by exploiting the diffuser effect. If the duct area increases uniformly to the exit so that the equivalent cone angle is less then 7°, the kinetic head associated therewith is converted into pressure head. Since the exit losses vary as the square of the velocity, if the exit area is doubled, the effective exit loss is reduced to about 0.25.

The one-way diffusers shown in FIGS. 3A and 3B and 4A and 4B are effective only for water flow in one direction. However, in most cases, this is sufficient to reduce the dissipation to the desired value. Note that some level of energy dissipation is required for optimal suppression of heave motion.

The effective duct length, one of the parameters in tuning tank resonance is reduced by flaring the duct. By adjusting the ratio of the smallest cross-sectional area of the duct to cross-sectional area of the tank, the loss of effective duct length can be compensated for.

Figure 4A:
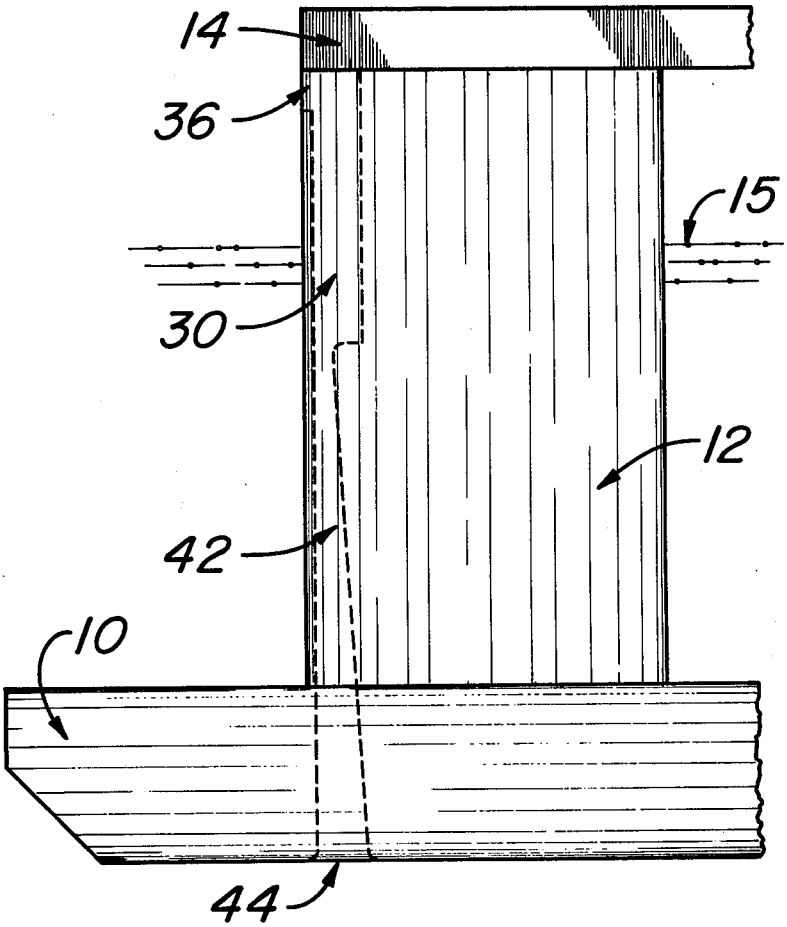
FIGS. 4A and 4B are a side view and a top view, respectively, of a second embodiment of the heave damper of the present invention.
Figure 4B:
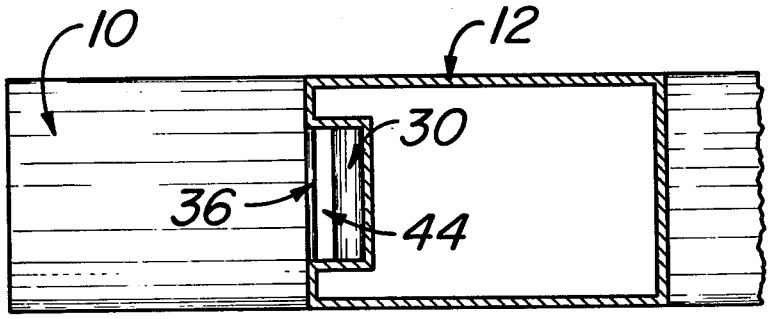

In the embodiment shown in FIGS. 4A and 4B, the cross-sectional area of opening 44 at the bottom of duct 42 is approximately twice the cross-sectional area of duct 42 near its connection with tank 30. The enlarged area of opening 44 is achieved by flaring the shape of the duct as it approaches opening 44. The amount of flare to duct 42 can be on the order of 5 to 6 degrees.

Figure 5A:
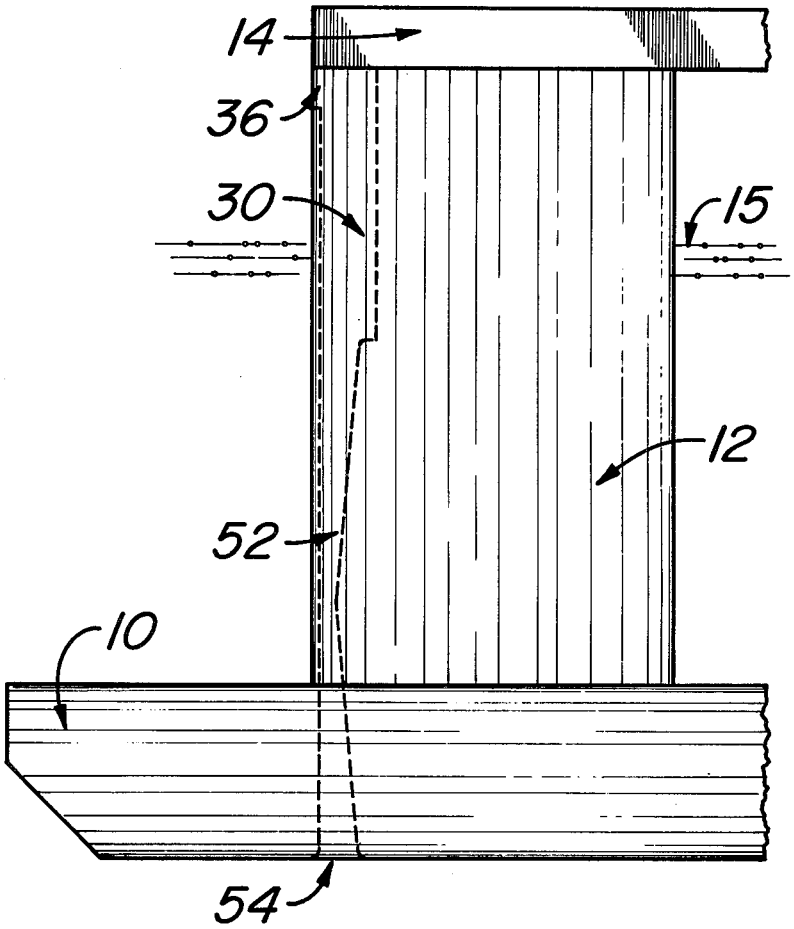
FIGS. 5A and 5B are a side view and a top view, respectively, of a third embodiment of the heave damper of the present invention.
Figure 5B:
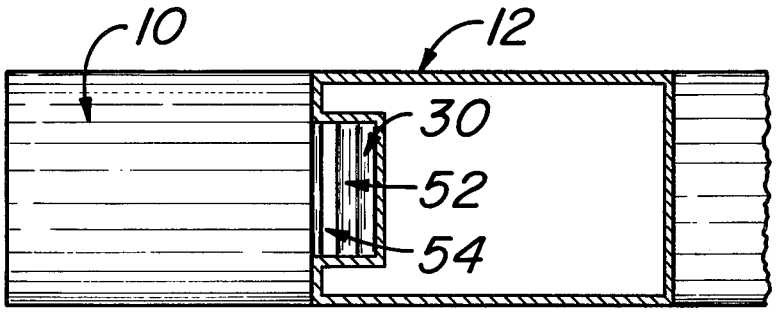

Referring to FIGS. 5A and 5B, another embodiment of the present invention comprises tank 30, mounted at a point where the ambient water line 15 intersects column 12, having air vent 36 above the ambient water line 15, and having shaped duct 52 extending down column 12 to opening 64. In this configuration, the duct comprises a two-way diffuser, effective for flow of water in both directions.

Figure 6A:
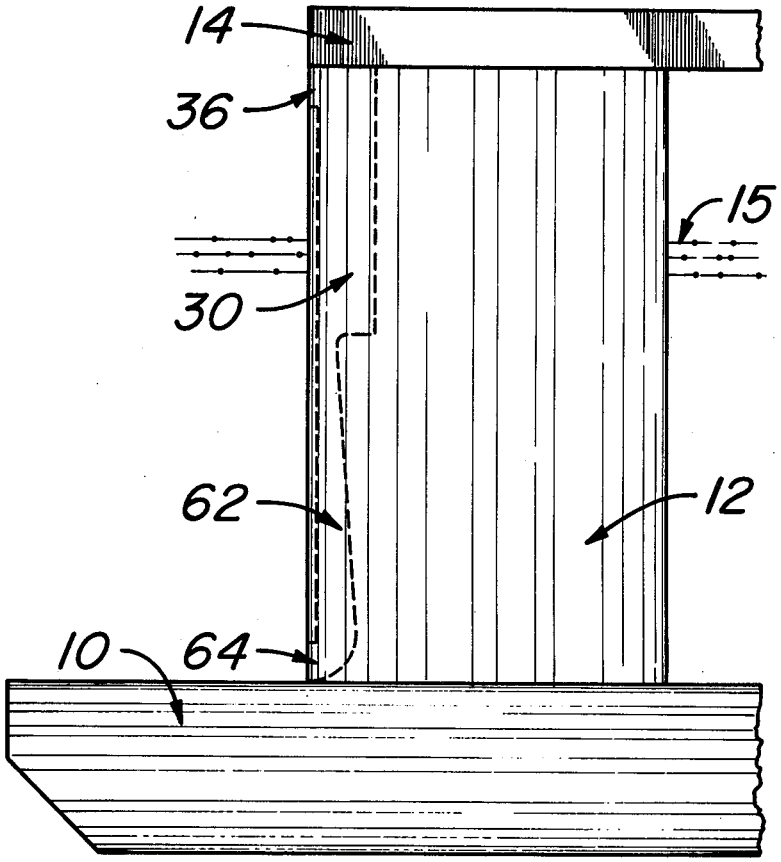
FIGS. 6A and 6B are a side view and a top view, respectively, of a fourth embodiment of the heave damper the present invention.
Figure 6B:
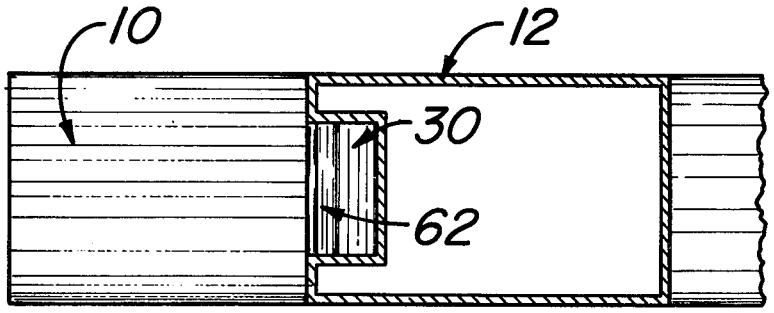
Figure 7A:
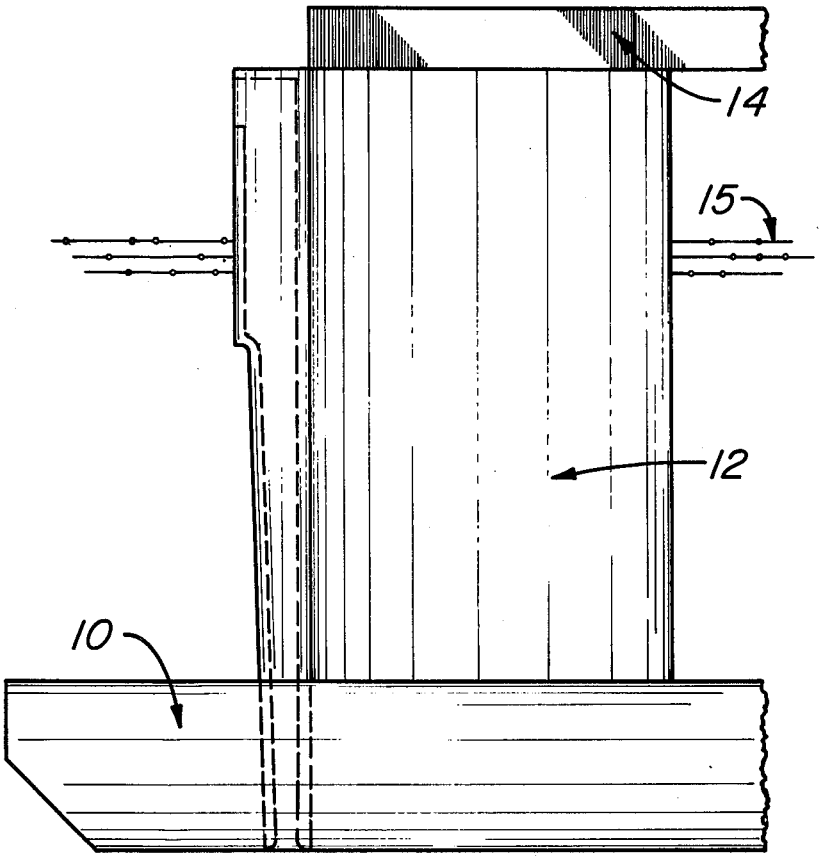
FIGS. 7A and 7B are a side view and a top view, respectively, of a passive heave damper constructed according to another embodiment of the present invention on one column of the platform of FIG. 1.
Figure 7B:
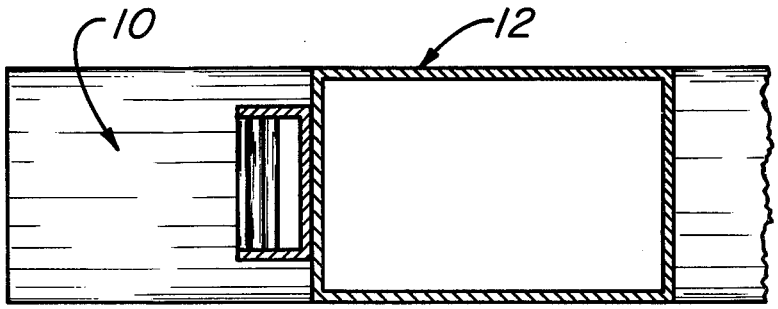
Figure 8A:
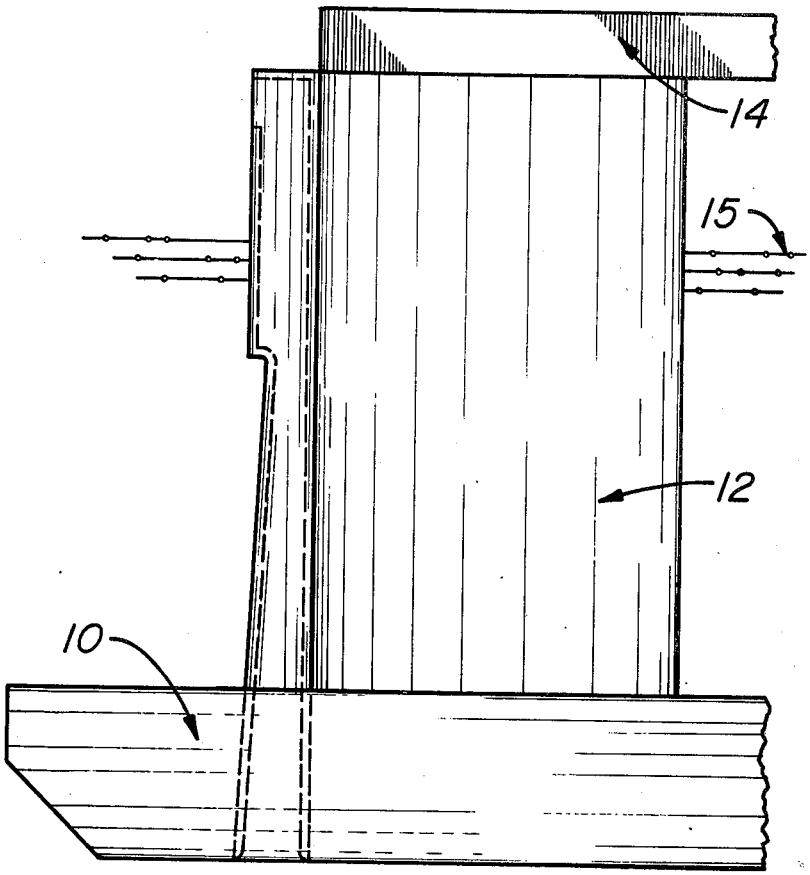
FIGS. 8A and 8B are a side view and a top view, respectively of a sixth embodiment of the heave damper of the present invention.
Figure 8B:
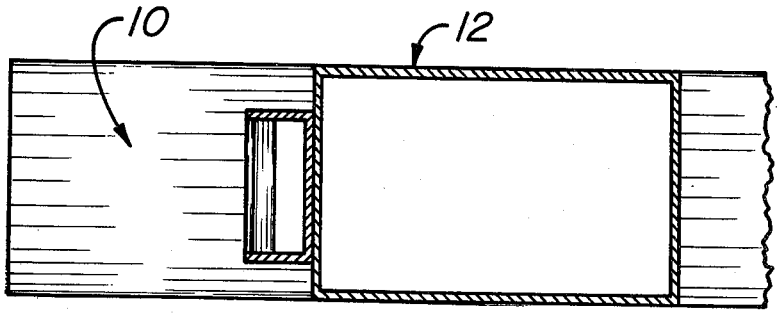
Figure 9A:
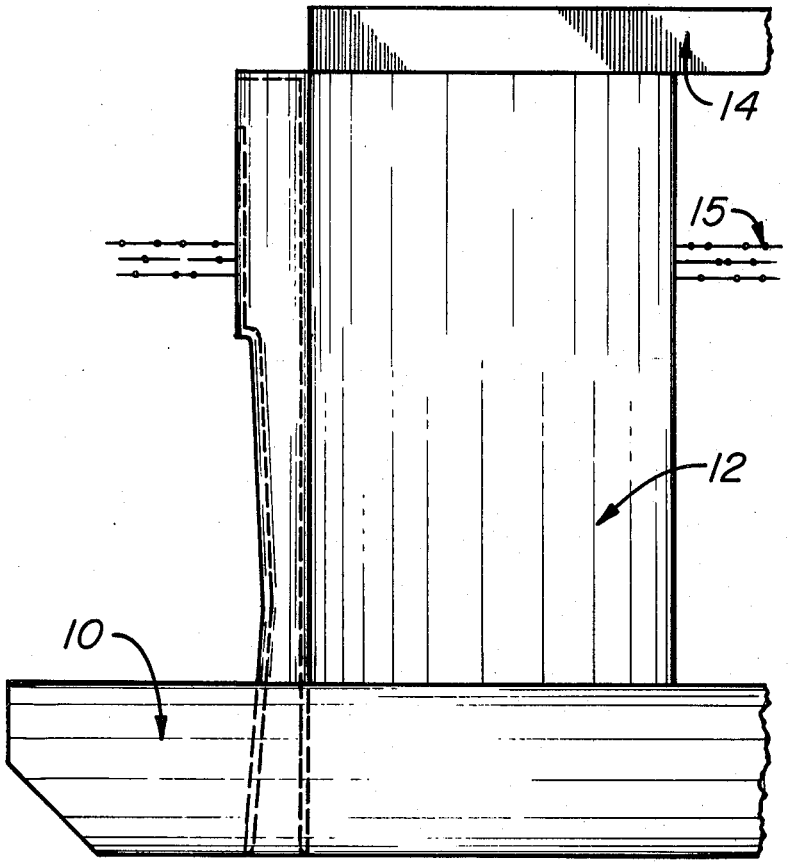
FIGS. 9A and 9B are a side view and a top view, respectively of a seventh embodiment of the heave damper of the present invention.
Figure 9B:
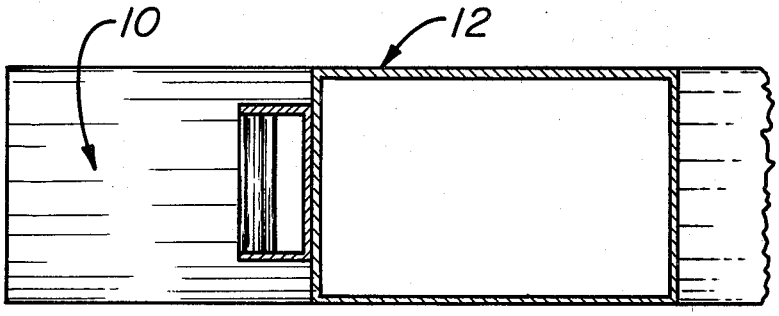
Figure 10A:
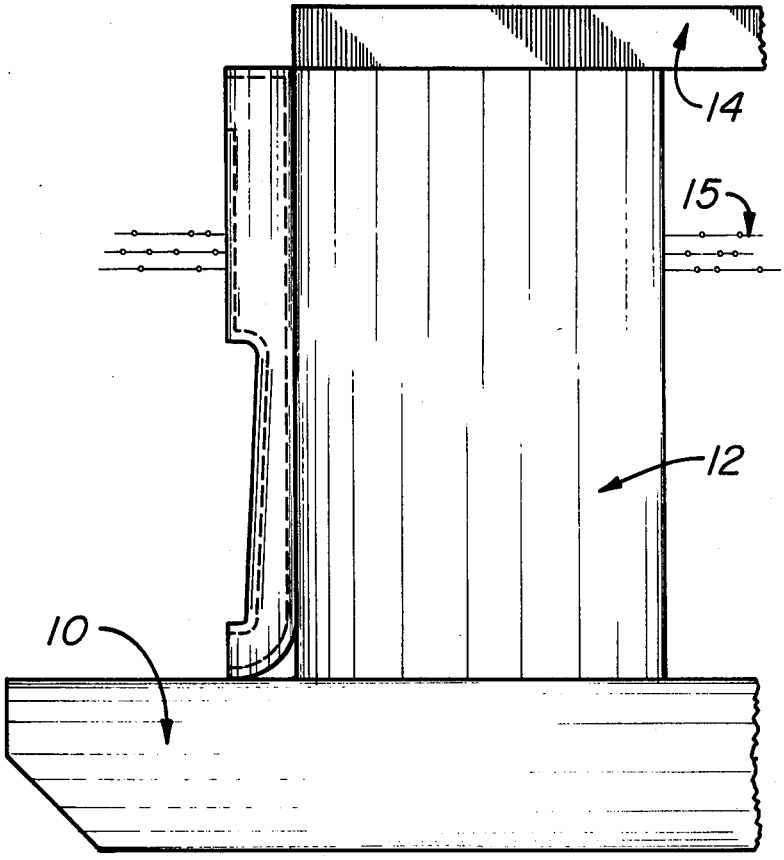
FIGS. 10A and 10B are a side view and a top view, respectively of an eighth embodiment of the heave damper of the present invention.
Figure 10B:
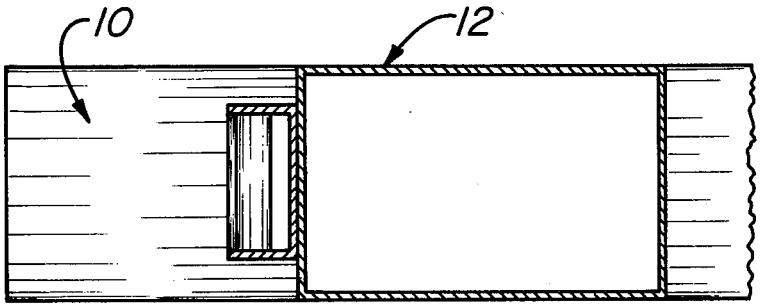

Referring now to FIGS. 6A and 6B, still another embodiment of the present invention comprises tank 30, located at the intersection of ambient water line 15 with column 12, having air vent 36 located above ambient water line 15, and having duct 62 extending down column 12 to opening 64, below the surface of the water, but above pontoon 10. It should be noted that the heave damper system of the present invention, comprising tank 30 with its respective vents, ducts and openings can also be mounted on the outside surface of column 12 so long as they ae mounted in the same relationship to the water line as shown in FIGS. 3A, 4A, 5A and 6A. It should also be noted that, while square tanks and columns are shown in this specification, the tanks may be of any convenient shape suitable for adapting to the inside or outside shape of the non-square columns. Thus, a shaped tank with duct extending from the bottom can be retrofit to the outside surface of a platform column. As for example see FIGS. 7A to 10B.

I claim:

1. Apparatus for stabilizing a semisubmersible platform having a plurality of flotation means, said system comprising:

One or more tanks, having open access to ambient air, mounted on the flotation means at a point where the ambient surface of the water intersects the flotation means; and One or more ducts, each having one end coupled to each of the tanks at a point below the ambient surface of the water, the other end of which having open access to the water at a point below the lowest point of each of the tanks;

Said ducts having a cross-sectional area which varies over substantially their entire length, the maximum cross-sectional area of said ducts being substantially less than the maximum cross-sectional area of the tanks, so that the resonant period of each tank and duct combination is approximately equal to the resonant heave period of the platform.

2. Apparatus for stabilizing a semisubmersible platform as in claim 1 wherein the flotation means includes vertical columns and horizontal pontoons.

3. Apparatus for stabilizing a semisubmersible platform as in claim 1 wherein said ducts have enlarged cross-sectional area at both ends.

4. Apparatus for stabilizing a semisubmersible platform as in claim 1 wherein said ducts have enlarged cross-sectional area near the end coupled to each of the tanks.

5. A semisubmersible platform including a resonant heave damper, said platform comprising:

A deck;

A plurality of vertical columns fixed to and extending below the said deck;

A plurality of pontoons fixed to at least some of the columns below said deck;

At least one tank located on one of said plurality of columns having open access to ambient air above the ambient surface of the water;

At least one duct having one end coupled to the bottom of the tank below the ambient surface of the water; and Said other end of the duct having open access to the water at the lowest point of the pontoons;

Said tank being mounted on said column at a point where the ambient surface of the water intersects the column;

Said ducts having a cross-sectional area which varies over substantially its entire length, the maximum cross-sectional area of said duct being substantially less than the maximum cross-sectional area of the tank, so that the resonant period of the tank and duct combination is approximately equal to the resonant heave period of the platform.

6. Apparatus for stabilizing a semisubmersible platform as in claim 5 wherein the cross-sectional area of the duct is less than the cross-sectional area of the tanks and is enlarged near the end having open access to the water at the bottom of the pontoons.

7. A semisubmersible platform as in claim 5 wherein the tank and duct are mounted on the outside surface of the column.

8. Apparatus for stabilizing a semisubmersible platform as in claim 5 wherein the cross-sectional area of the ducts is enlarged at both ends.

9. Apparatus for stabilizing a semisubmersible platform as in claim 5 wherein the cross-sectional area of the ducts is enlarged near the end coupled to the bottom of the tank.

10. Apparatus for stabilizing a semisubmersible platform as in claim 1 wherein the tank and ducts are mounted on the outside surface of the flotation means.

11. Apparatus as in claim 1 wherein the cross-sectional area of the ducts gradually increases over their entire length from the end coupled to the tanks to the end having open access to the water.

12. Apparatus as in claim 1 wherein the cross-sectional area of the ducts gradually decreases over their entire length from the end coupled to the tanks to the end having open access to the water.

13. Apparatus as in claim 1 wherein the cross-sectional area of the ducts gradually decreases to a point approximately midway along their length from the end coupled to the tanks, then gradually increases from said point to the end having open access to the water.

14. Apparatus as in claim 1 wherein the tanks are mounted within the flotation means.

15. Apparatus as in claims 1 or 5 wherein the ducts have enlarged cross-sectional area near the end having open access to the water.

* * * * *